US012140408B1

(12) United States Patent
Rascon et al.

(10) Patent No.: US 12,140,408 B1
(45) Date of Patent: Nov. 12, 2024

(54) HEAVY INERT GAS INSULATED WARHEAD

(71) Applicant: Raytheon Company, Tewksbury, MA (US)

(72) Inventors: John Rascon, Tucson, AZ (US); Mark J. Meisner, Tucson, AZ (US); Manuel E. Gonzales, Tucson, AZ (US)

(73) Assignee: Raytheon Company, Tewksbury, MA (US)

( * ) Notice: Subject to any disclaimer, the term of this patent is extended or adjusted under 35 U.S.C. 154(b) by 0 days.

(21) Appl. No.: 18/471,855

(22) Filed: Sep. 21, 2023

(51) Int. Cl.

| | |
|---|---|
| ***F42B 12/20*** | (2006.01) |
| ***F42B 12/22*** | (2006.01) |
| ***F42B 39/14*** | (2006.01) |
| ***F42B 39/18*** | (2006.01) |

(52) U.S. Cl.
CPC ..... *F42B 39/18* (2013.01); *F42B 12/20* (2013.01); *F42B 12/22* (2013.01); *F42B 39/14* (2013.01)

(58) Field of Classification Search
CPC ..... F42B 12/20; F42B 12/22; F42B 12/72; F42B 12/76; F42B 39/14; F42B 39/16; F42B 39/18; F42B 39/20
USPC ..... 102/481
See application file for complete search history.

(56) References Cited

U.S. PATENT DOCUMENTS

| | | | | |
|---|---|---|---|---|
| 3,152,548 | A * | 10/1964 | Schwartz | B64C 1/40 52/378 |
| 3,992,997 | A | 11/1976 | Mccubbin et al. | |
| 4,041,869 | A * | 8/1977 | San Miguel | F02K 9/346 102/481 |
| 6,935,594 | B1 * | 8/2005 | Vaidyanathan | F42B 10/46 428/113 |
| 8,302,768 | B2 * | 11/2012 | Sibley | F42B 39/22 89/34 |
| 10,760,531 | B2 * | 9/2020 | Brennan | F02K 9/972 |
| 12,065,990 | B1 * | 8/2024 | Rascon | F02K 9/972 |

* cited by examiner

*Primary Examiner* — James S Bergin
(74) *Attorney, Agent, or Firm* — Schwegman Lundberg & Woessner, P.A.

(57) ABSTRACT

A heavy inert gas insulation layer is wrapped around the length of a warhead to thermally insulate the warhead from fire or aerodynamic heating. The insulation layer may be integrally formed into the warhead casing or provided as a sleeve that may be permanently or removably positioned about the warhead casing. The insulation layer contains an inert gas such as Argon, Krypton, Xenon or a synthetic gas having a density of at least 1.5 kg/m$^3$ and a thermal conductivity Tcond_gas no greater than two-thirds of the thermal conductivity of air Tcond_air.

19 Claims, 6 Drawing Sheets

300

| THERMAL CONDUCTIVITY (W/mK) | |
|---|---|
| ALUMINUM ALLOY | 1.9 |
| AIR | 0.026 |
| ARGON | 0.017 |
| KRYPTON | 0.0087 |
| XENON | 0.0052 |

HEAVY INERT GAS INSULATED WARHEAD

BACKGROUND

Field

This disclosure relates to thermal insulation of warheads to counter the effects of heating such as through fires on or near the warhead or aerodynamic heating.

Description of the Related Art

Exposure to high temperatures can degrade or desensitize explosive material inside a warhead. The effects may be premature detonation or a degraded ability to controllably detonate the explosive material. Thermal insulation is placed around the warhead to protect the explosive material. Ideally, the thermal insulation would have minimal impact on weight, volume or performance of the warhead.

The warhead is typically subjected to a number of tests to ensure the thermal design. A "slow cook-off" test subjects the warhead to temperatures that may be associated with a fire close to the warhead such as might occur in a warehouse. A "fast cook-off" test subjects the warhead to temperatures that may be associated with a fire on the warhead such as might occur on a tarmac or carrier due to a fuel ignition. Lastly, "in flight" tests subject the warhead to temperatures that may be associated with launch and flight to target of the warhead. The warhead must pass all of the tests.

U.S. Pat. No. 3,992,997 entitled "Warhead Casing" discloses a warhead casing designed to protect the high explosive material therein from open fires or other sources of intense heat which might cause premature explosion of the warhead. The warhead casing is relieved throughout the greater part of its outer circumference and may be then counter-relieved over a slightly lesser distance. The relieved area is filled with an ablative (insulating) material covered by a protective intumescent coating, for example, of fire resistant, impregnated cloth. The insulating material may, for example, include granulated cork bonded with a synthetic resin binder, a carbonized asbestos or Teflon.

As shown in FIGS. 1A-1B, thermal insulation may be provided by positioning a warhead 100 inside an airframe of a missile, rocket, guided projectile, or the like and spaced from the airframe skin 102. Warhead 100 includes a casing 104 and explosive 106 positioned inside the casing. A conductive layer 108 such as Aluminum is wrapped around and spaced apart from both the casing 104 and the airframe skin 102 to form inner and outer air gaps 110 and 112 above and below the conductive layer 108. The sandwich of inner air gap 110, conductive layer 108 and outer air gap 112 forms an insulating layer 114 that serves to insulate warhead 100 from heating of the airframe skin 102 such as through fires on or near the warhead or aerodynamic heating.

Heat forms on airframe skin 102 due to a fire or aerodynamic drag. This heat radiates into outer air gap 112 energizing molecules in the air causing the molecules to bounce around and transfer heat to conductive layer 108. The heat is absorbed on an outer surface of conductive layer 108, which then propages to the inner air gap 110, which heats up and transfers heat to casing 104. The conductive layer 108 serves to block the hot excited molecules in the outer air gap 112 from directly impinging upon and heating casing 104. The effects is to slow heat transfer from the airframe skin 102 to casing 104. A metal material is used for the conductive layer 108 instead of an insulating material to address other concerns for missiles, rockets, guided projectiles or the like such as the ability to maintain physical integrity over a long life span.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides an insulated warhead in which a heavy inert gas insulation layer is wrapped around the length of the warhead. In different configurations, the heavy inert gas insulation layer may reduce weight or volume occupied by the requisite thermal insulation. If the warhead produces a fragmentation pattern, the heavy inert gas insulation layer has negligible impact on the fragmentation pattern or velocity of the fragments.

A void space is formed in or around the warhead casing. A vacuum is pulled on the void space, which is then filled with a heavy inert gas at a pressure of 760 Torr (1 atm) or more (assuming operation of the rocket at or near sea level and room temperature of 25 C) to form the heavy inert gas insulating layer. The heavy inert gas insulating layer has a thermal conductivity Tcond_gas no greater than two-thirds the thermal conductivity of air Tcond_air. The heavy inert gas has a density greater than 1.5 kg/m$^3$ (by comparison air is 1.29 kg/m$^3$). This includes Argon (Ar), Krypton (Kr), Xenon (Xe) and any synthetic inert gas of sufficient density. Inert gases will not react with temperature or other compounds and thus are very stable and safe over the life of the blast tube. Heavy gases include heavier particles, which transfer heat more slowly and thus are better insulators.

In an embodiment, the heavy inert gas insulation layer is integrally formed into the warhead casing.

In an embodiment, the heavy inert gas insulation layer is formed as a sleeve that fits over the warhead casing. The sleeve may be permanently fixed to the warhead or removable such as when only used for purposes of storing the warhead. The sleeve may be used with warhead casings formed of either metal or composite materials.

These and other features and advantages of the disclosure will be apparent to those skilled in the art from the following detailed description of preferred embodiments, taken together with the accompanying drawings, in which:

DETAILED DESCRIPTION

In the present disclosure, a heavy inert gas insulation layer is wrapped around the length of a warhead to thermally insulate the warhead from fire or aerodynamic heating. The insulation layer may be integrally formed into the warhead casing or provided as a sleeve that may be permanently or removably positioned about the warhead casing. The insulation layer contains an inert gas having a density of at least 1.5 $Kg/m^3$ and a thermal conductivity Tcond_gas of no greater than two-thirds of the thermal conductivity of air Tcond_air. Suitable inert gases include Argon, Krypton or Xenon or a synthetic inert gas of sufficient density. In different configurations, the heavy inert gas insulation layer may reduce weight or volume occupied by the requisite thermal insulation. If the warhead produces a fragmentation pattern, the insulation layer has negligible impact on the fragmentation pattern or velocity of the fragments.

Figure 2B:
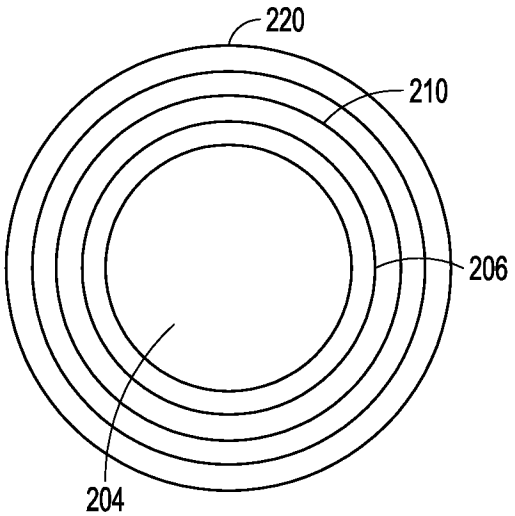
FIGS. 2A-2B are sectional and end views of an embodiment of a heavy inert gas insulated warhead positioned inside an airframe of the weapon system.
Figure 2A:
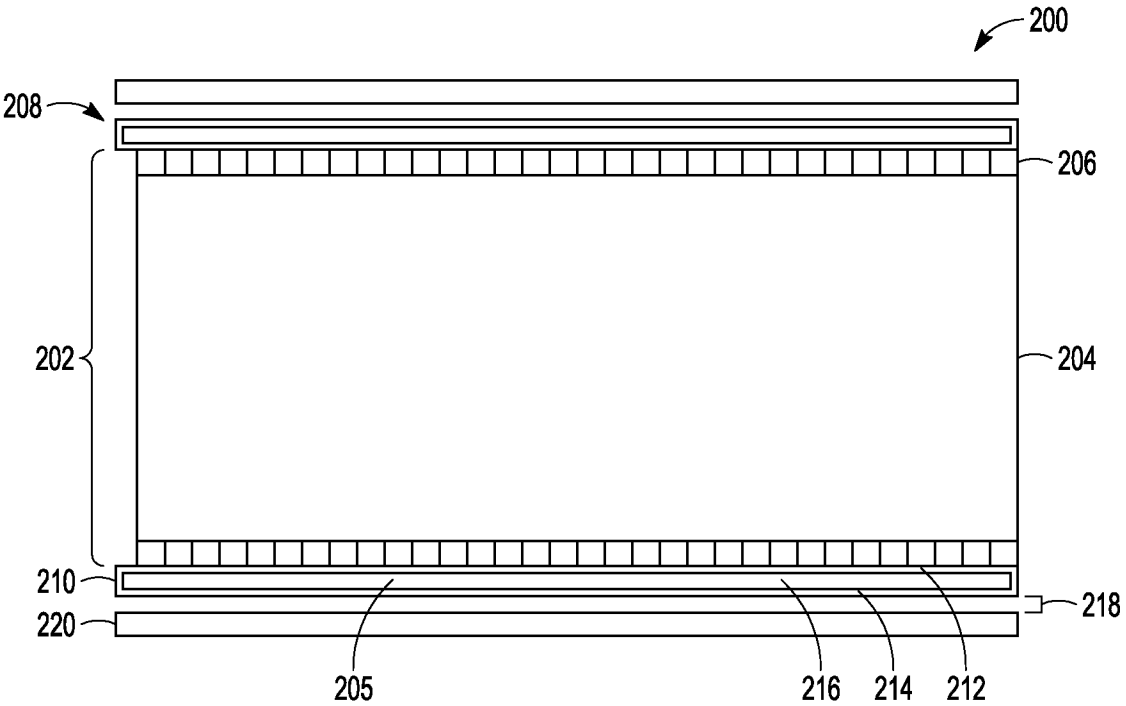

As shown in FIGS. 2A-2B, an embodiment of an insulated warhead 200 includes a warhead 202 in which an explosive material 204 is positioned inside a warhead casing 206 and a heavy inert gas insulation layer 208 wrapped around a length of warhead 202.

An insulated casing 210 including inner and outer walls 212 and 214 defines an annular void space 216 around a length of the warhead casing 206 and explosive material 204. The annular void space 216 contains an inert gas 205 having a density of at least 1.5 $kg/m^3$ and a thermal conductivity Tcond_gas of no greater than two-thirds of the thermal conductivity of air Tcond_air to form heavy inert gas insulation layer 208.

A vacuum is pulled on the void space 216, which is then filled with a heavy inert gas 205 at a pressure of 760 Torr (1 atm) or more (assuming operation of the rocket at or near sea level and room temperature of 25 C) and sealed to form the heavy inert gas insulating layer 208. This layer has a thermal conductivity Tcond_gas no greater than two-thirds the thermal conductivity of air Tcond_air. The heavy inert gas has a density greater than 1.5 $kg/m^3$ (by comparison air is 1.29 $kg/m^3$). This includes Argon (Ar), Krypton (Kr), Xenon (Xe) and any synthetic inert gas of sufficient density. Inert gases from Group 8A of the periodic table will not react with temperature or other compounds and thus are very stable and safe over the life of the blast tube. Heavy gases (those having a density greater than air) include heavier particles, which transfer heat more slowly and thus are better insulators.

Figure 1B:
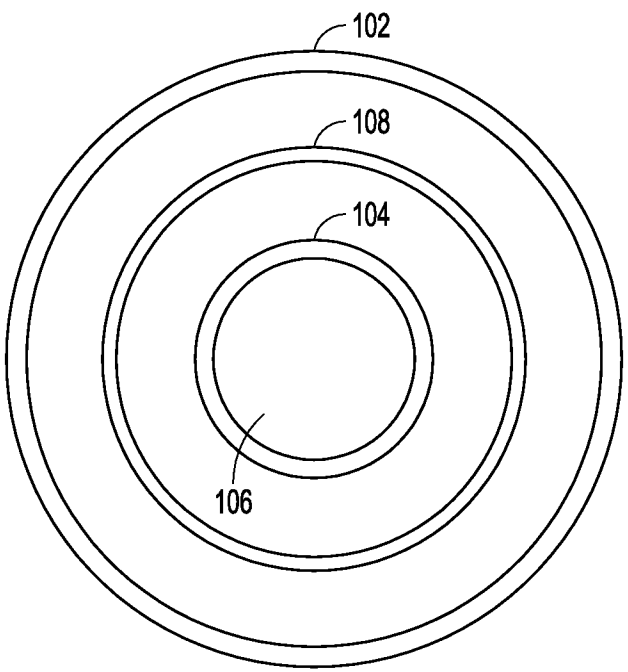
FIG. 1B (PRIOR ART)
FIGS. 1A-1B, as described above, are sectional and end views of an insulated warhead positioned inside an airframe of the weapon system.
Figure 1A:
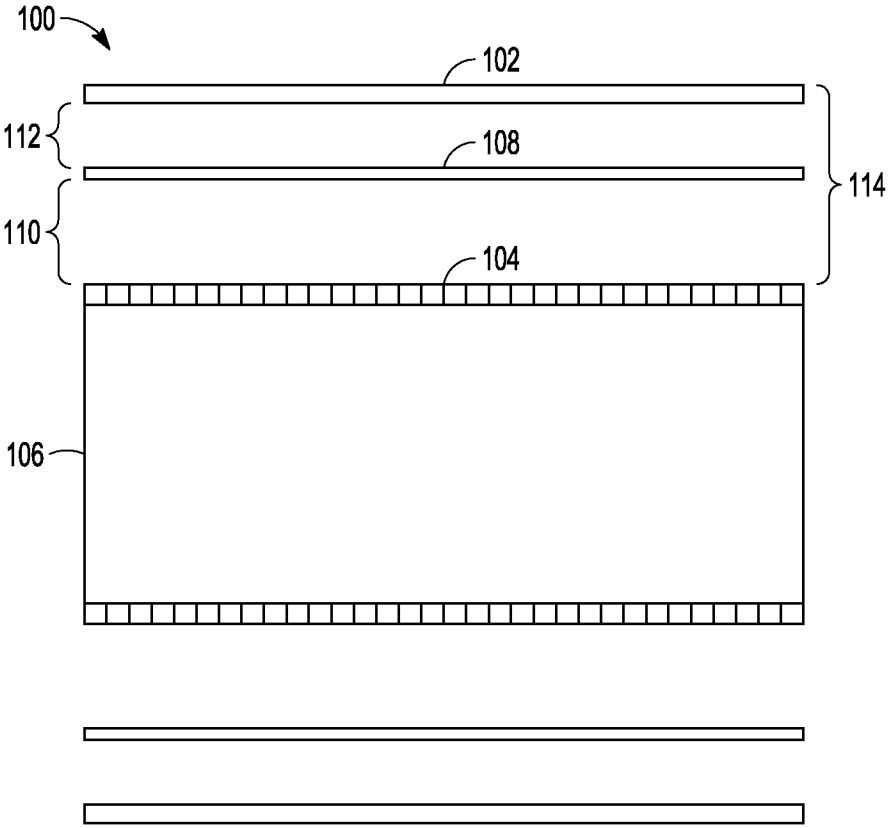
FIG. 1A (PRIOR ART)

Heavy inert gas insulation layer 208 can provide equivalent or better thermal insulation than the insulation layer (air gap/conductive layer/air gap) 114 shown in FIGS. 1A-1B with a far thinner layer. This may both reduce weight and occupied volume for the insulated warhead. As shown in FIG. 2A, when positioned within an air frame the requisite air gap 218 between the warhead 202 and airframe skin 220 need only be large enough for physical tolerances. The air gap 218 does not meaningfully contribute to the thermal insulation.

As will be discussed later, the heavy inert gas insulation layer 208 may be integrally formed into the warhead casing 206 or provided as a sleeve that may be permanently or removably positioned about the warhead casing 206. For example, the sleeve may be used to provide thermal insulation and protection from fires during storage of certain warheads but removed when the warhead is assembled with the air frame or loaded in a launch system. The sleeve, which is formed from a material such as metal suitable to contain the heavy inert gas for long periods of time, may be used with a warhead casing of the same material or a different material such as in the case of a composite casing.

Figures 3A, 3B:
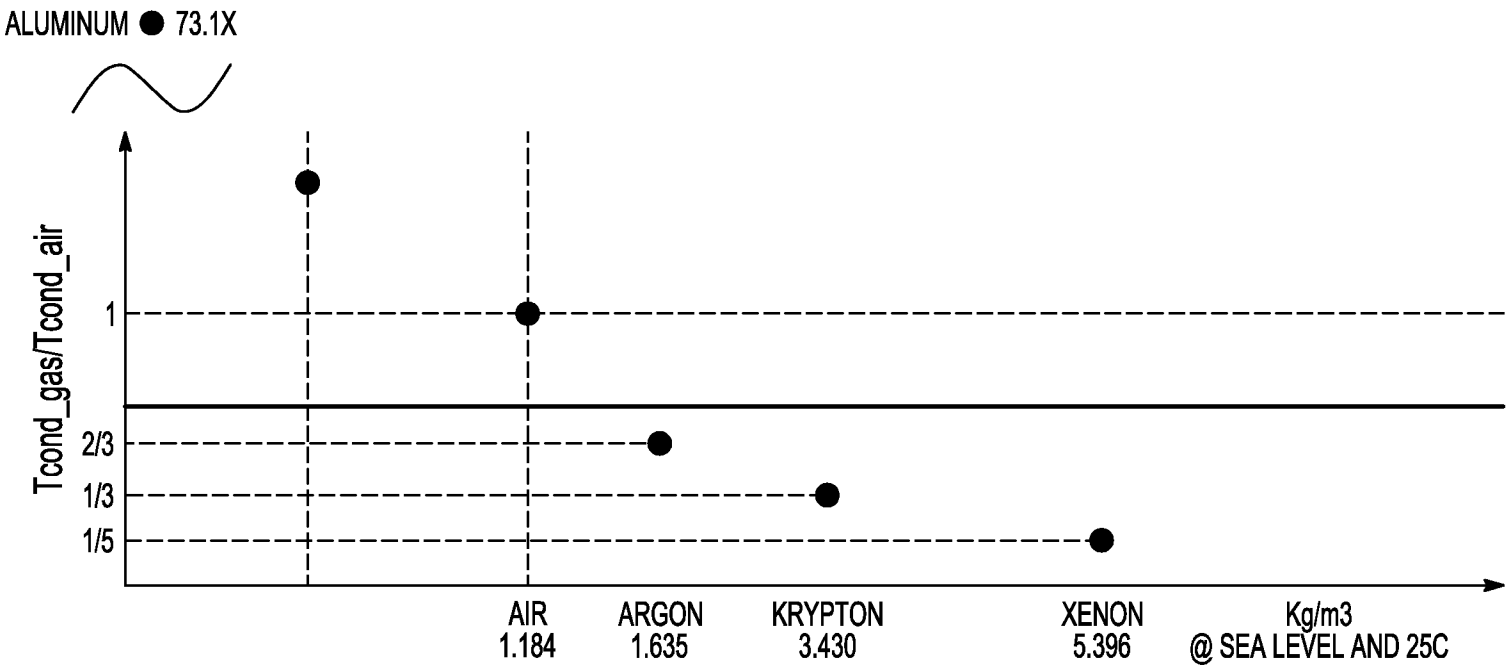
FIGS. 3A and 3B are a Table and plot of the relative thermal conductivity of heavy inert gases to air.

Referring now to Table 300 of FIG. 3A and a plot 302 of the relative thermal conductivity of different heavy inert gases to air in FIG. 3B, at sea level and a temperature of 25 C, air has a thermal conductivity of approximately 0.026 W/mK, aluminum of approximately 1.9 W/mK and Ar, Kr and Xe have thermal conductivities of approximately 0.017, 0.0087 and 0.0052 W/mK, respectively. Ar, Kr and Xe have thermal conductivities of approximately two-thirds, one-third and one-fifth that of air. This provides a substantial thermal insulating benefit over an air gap or an insulating layer formed as an air gap/conductive layer/air gap.

Figure 4A:
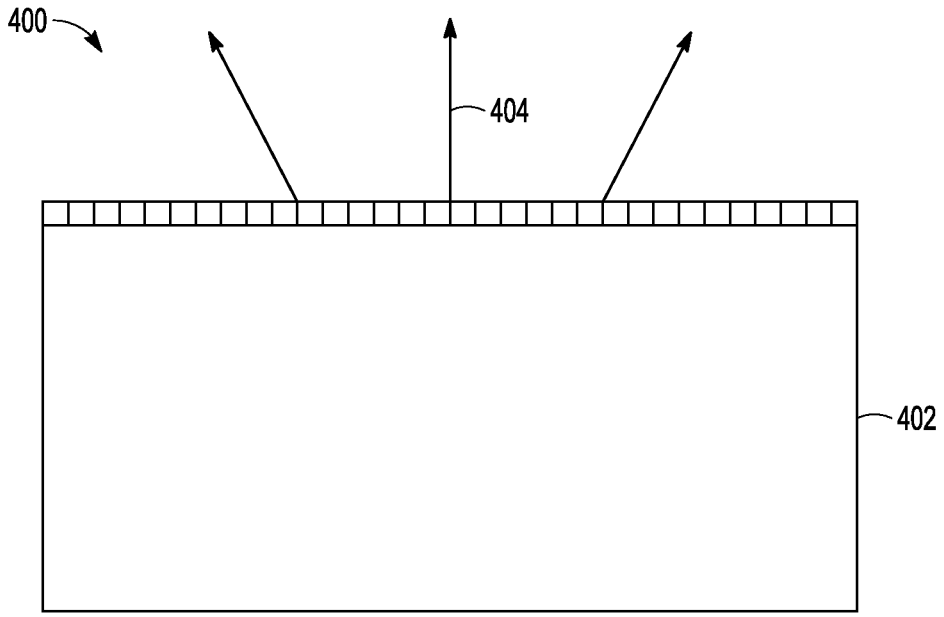
FIGS. 4A-4C are drawings depicting the effects on a warhead fragmentation pattern of different insulating techniques.
Figure 4B:
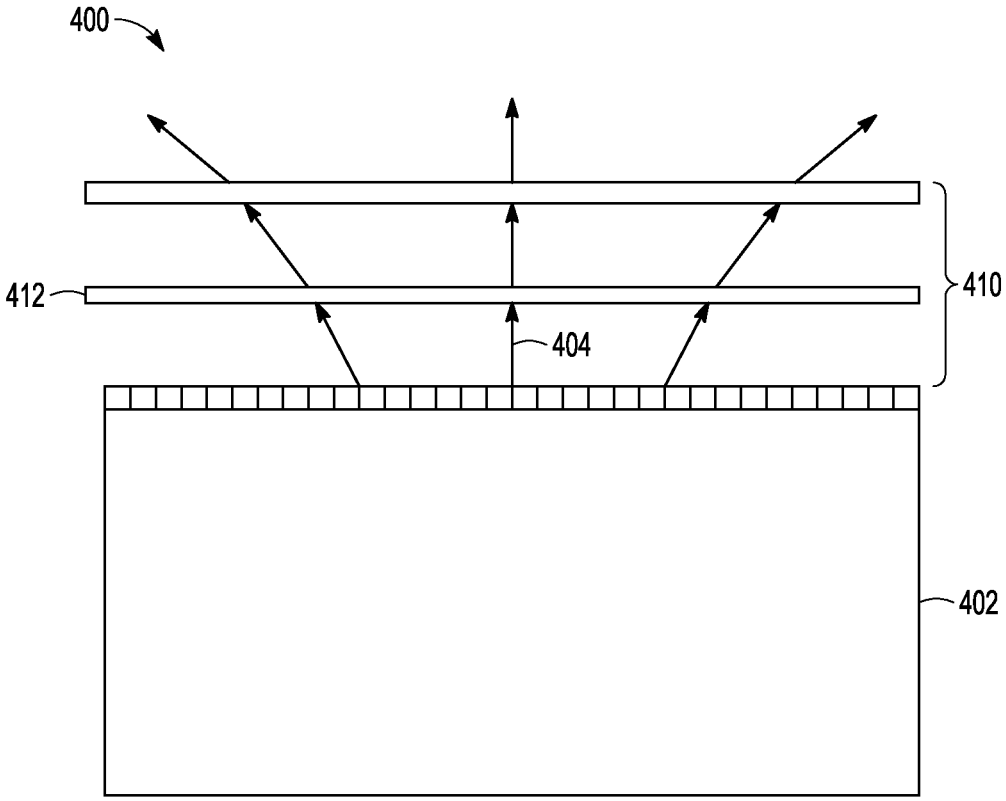
Figure 4C:
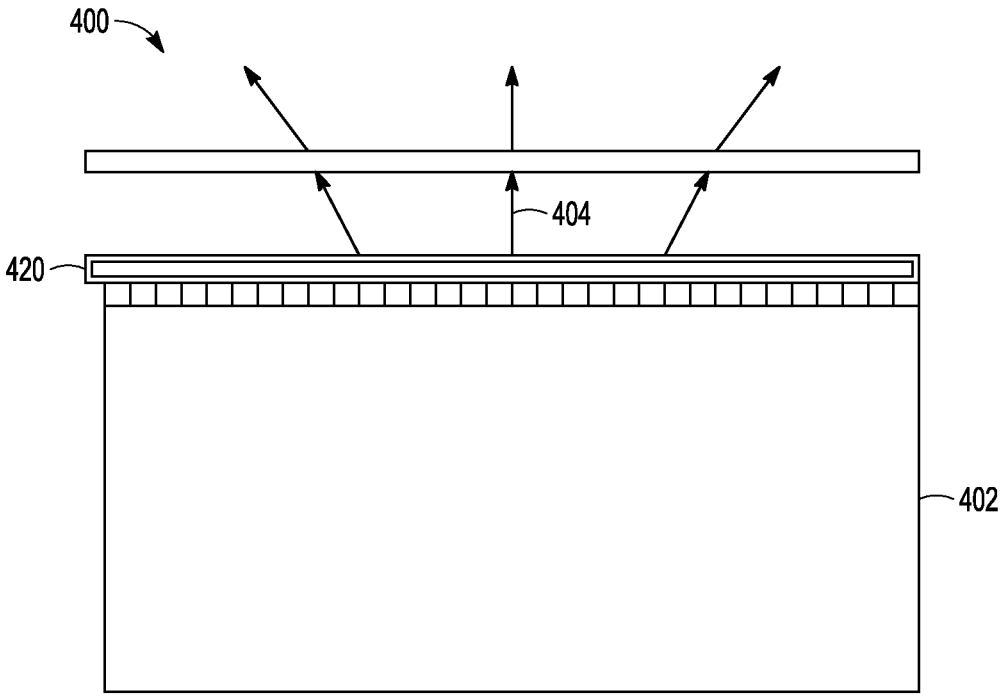

FIGS. 4A-4C illustrate a fragmentation pattern 400 for a fragmentation warhead 402 and the possible degradation of the fragmentation pattern in both the desired pattern and fragment velocity attendant to the different techniques for thermally insulating warhead 402. In this example, detonation of warhead 402 throws fragments 404 radially into a conic fragmentation pattern 400 at a desired fragment velocity. Any distortion of the pattern or slowing of the fragments is undesired.

Although not illustrated here, the layers of ablative (insulating material) and a protective intumescent coating formed in relieved areas of the warhead coating described in U.S. Pat. No. 3,992,997 will, upon detonation, tend to rip and tear and stick to fragments 404 thereby distorting the fragment pattern and reducing the velocity of the fragments.

As shown in FIG. 4B, the use of an insulating layer 410 formed as an air gap/conductive layer 412/air gap around warhead 402 will also degrade the fragment pattern and reduce fragment velocities. Upon detonation, conductive layer 412 will maintain physical integrity long enough to redirect and slow fragments 404.

As shown in FIG. 4C, the use of a heavy inert gas insulating layer 420 around warhead 402 has minimal impact on fragmentation pattern 400. Upon detonation, the insulating layer 420 collapses and creates fragments that do not impact the fragmentation pattern 400.

Figure 5:
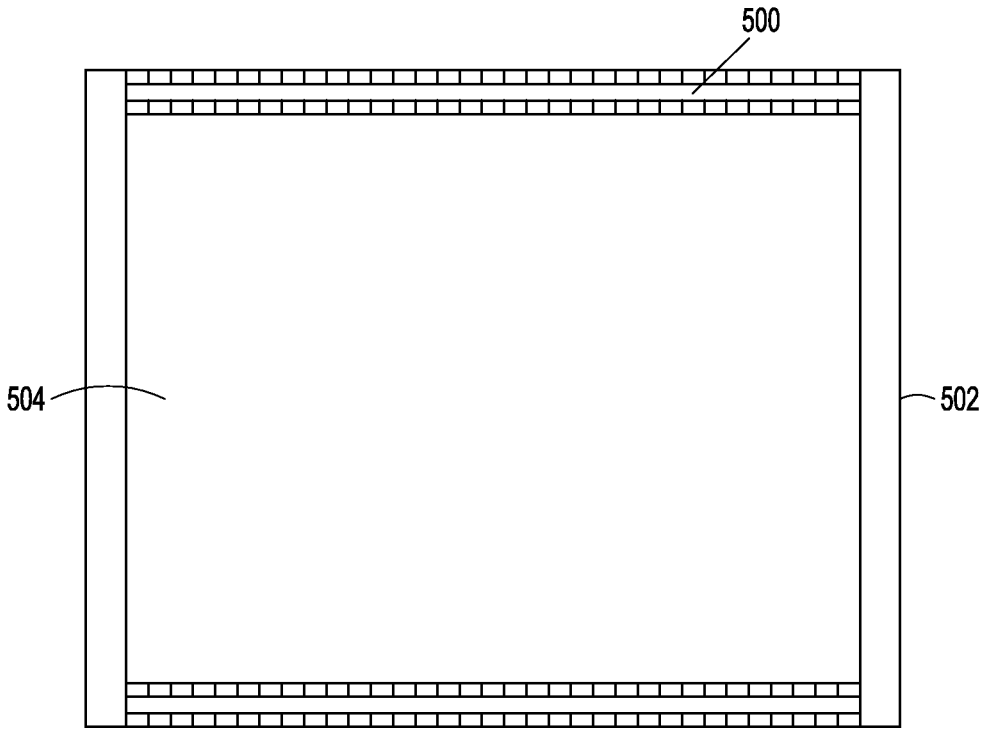
FIG. 5 is a drawing in which the heavy inert gas insulation layer is integrated into the warhead casing.

As shown in FIG. 5, a heavy inert gas insulating layer 500 is integrally formed in a warhead casing 502 that contains explosive 504. Warhead casing 502 must be formed of a material, typically metals such as titanium, steel or aluminum, to contain the heavy inert gases and sustained for the life of the warhead, or at least until the warheads are inspected and maintained.

Figure 6:
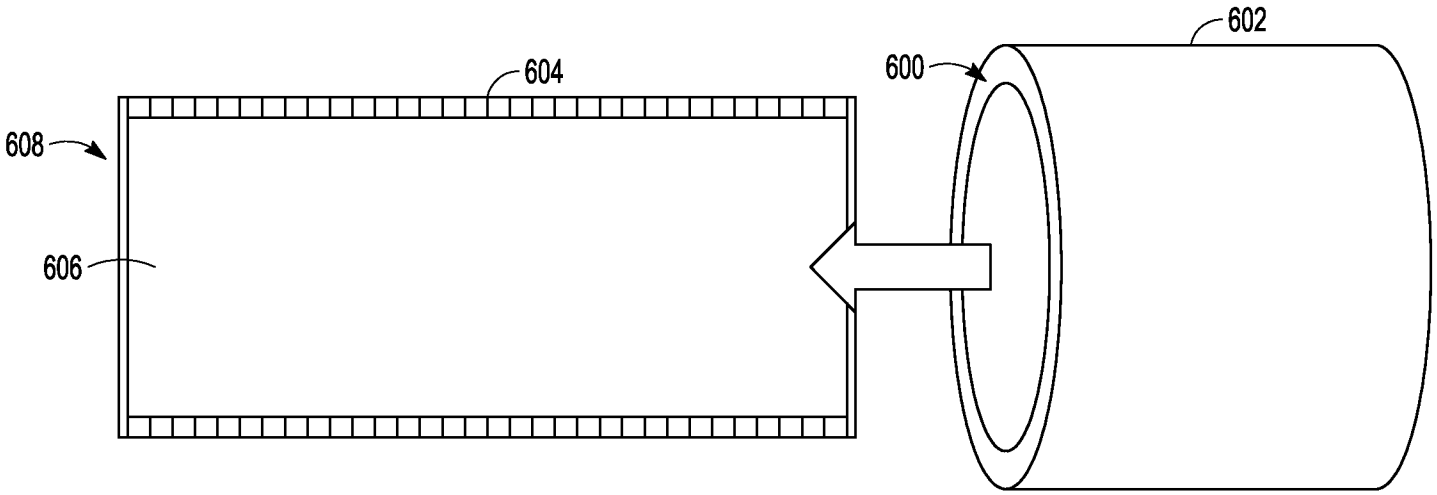
FIG. 6 is a drawing in which the heavy inert gas insulation is provided as a sleeve that is either permanently or removably fitted over the warhead casing.

As shown in FIG. 6, a heavy inert gas insulating layer 600 is integrally formed in a sleeve 602, which fits over the warhead casing 604 that contains explosive 606 to form a warhead 608. Sleeve 602 may be permanently or removably positioned about the warhead casing 604. For example, the sleeve may be used to provide thermal insulation and protection from fires during storage of certain warheads but removed when the warhead is assembled with the air frame or loaded in a launch system. Or the sleeve may be positioned over warhead 608 and then assembled into an airframe. The sleeve 602, which is formed from a material such as metal suitable to contain the heavy inert gas for long periods of time, may be used with a warhead casing of the same material or a different material such as in the case of a composite casing.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. A warhead, comprising:

an explosive material positioned inside a warhead casing; and an insulated casing including inner and outer walls defining an annular void space around a length of the warhead casing and explosive material, wherein the annular void space contains an inert gas having a density of at least 1.5 kg/m$^3$ and a thermal conductivity Tcondgas no greater than two-thirds of the thermal conductivity of air Tcond_air to form a heavy inert gas insulation layer around the length of the warhead casing and explosive material.

2. The warhead of claim 1, wherein the void space has a pressure of 760 Torr or greater.

3. The warhead of claim 1, wherein the inert gas is Argon, Krypton, Xenon.

4. The warhead of claim 3, wherein Tcond_gas for Argon, Krypton and Xenon is two-thirds, one-third and one-fifth that of Tcond_air, respectively.

5. The warhead of claim 1, wherein the inert gas is a synthetic gas.

6. The warhead of claim 1, wherein the warhead casing is formed of a metal material and the inner and outer walls are integrally formed with the warhead casing.

7. The warhead of claim 1, wherein the inner and outer walls are formed as a sleeve that fits over the warhead casing.

8. The warhead of claim 7, wherein the warhead casing wall is formed of a composite material.

9. The warhead of claim 7, wherein the sleeve is permanently affixed to the warhead casing.

10. The warhead of claim 7, wherein the sleeve is removable.

11. The warhead of claim 1, wherein the warhead casing is formed of a metal material that forms a fragmentation layer, which upon detonation of the explosive material fragments with the outer wall to form a fragmentation pattern.

12. A warhead, comprising:

an explosive material; and an integrally formed insulated metal warhead casing including an inner wall around a length of the explosive that forms a fragmentation layer and an outer wall that defines an annular void space, wherein the annular void space contains an inert gas having a density of at least 1.5 kg/m$^3$ and a thermal conductivity Tcond_gas of no greater than two-thirds the thermal conductivity of air Tcond_air to form a heavy inert gas insulation layer around the length of the warhead casing and explosive material.

13. The warhead of claim 12, wherein the inert gas is Argon, Krypton, Xenon or a synthetic gas.

14. The warhead of claim 12, wherein upon detonation of the explosive material the fragmentation layer and outer wall fragment to form a fragmentation pattern.

15. A warhead, comprising:

an explosive material positioned inside a warhead casing; and a sleeve including inner and outer walls defining an annular void space that slides around the warhead casing and explosive material, wherein the annular void space contains an inert gas having a density of at least 1.5 kg/m$^3$ and a thermal conductivity Tcond_gas no greater than two-thirds the thermal conductivity of air Tcond_air to form a heavy inert gas insulation layer around a length of the warhead casing and explosive material.

16. The warhead of claim 15, wherein the warhead casing wall is formed of a composite material.

17. The warhead of claim 15, wherein the sleeve is permanently affixed to the warhead casing.

18. The warhead of claim 15, wherein the sleeve is removable.

19. The warhead of claim 15, wherein the inert gas is Argon, Krypton, Xenon or a synthetic gas.

* * * * *